United States Patent [19]

Wynne

[11] 4,140,867

[45] Feb. 20, 1979

[54] FAIL-SAFE MECHANISM FOR ELECTRIC ARC FURNACES

[75] Inventor: Peter J. Wynne, Pittsburgh, Pa.

[73] Assignee: Lectromelt Corporation, Pittsburgh, Pa.

[21] Appl. No.: 856,675

[22] Filed: Dec. 2, 1977

[51] Int. Cl.[2] ..... H05B 7/109

[52] U.S. Cl. ..... 13/16; 13/9 R

[58] Field of Search ..... 13/1, 9, 10, 14–17, 13/13

[56] References Cited

U.S. PATENT DOCUMENTS

| | | | |
|---|---|---|---|
| 2,148,834 | 2/1939 | Payne | 13/16 |
| 2,290,030 | 7/1942 | Brooke | 13/16 |
| 2,851,287 | 9/1958 | Tangard | 13/16 X |
| 2,899,477 | 8/1959 | Cartoux | 13/16 |

*Primary Examiner*—R. N. Envall, Jr.
*Attorney, Agent, or Firm*—Fred Wiviott

[57] ABSTRACT

An electric arc furnace has a plurality of electrodes each supported at one end of an arm, the other ends of which are each coupled to a column supported for vertical movement by means of a cable assembly. A fail-safe assembly is mounted adjacent the column and is coupled to the cable assembly. While tension is maintained in the support cable a linkage assembly normally restrains a biasing spring from moving a clamping wedge into engagement with the column to prevent vertical movement thereof. When tension is lost in the cable assembly the biasing spring is released to move the wedge into engagement with the column.

23 Claims, 8 Drawing Figures

FAIL-SAFE MECHANISM FOR ELECTRIC ARC FURNACES

BACKGROUND OF THE INVENTION

Electric arc furnaces commonly include a furnace body consisting of a metalic shell and a refractery lining which define a hollow enclosure along with a removable cover through which one or more electrodes extend. Such furnace bodies are normally mounted on the platform which pivots about a horizontal axis for pouring molten metal from the furnace upon pivotal movement in one direction and for deslagging upon pivotal movement in an opposite direction. The furnace cover and electrodes are generally supported for translation from a position above the furnace to a remote position so that the furnace may be charged with a ferrous material such as pelletized iron or scrap. In order to permit such movement of the cover from above the furnace body to a remote position and for return movement thereof, the furnace electrodes must be elevated so that their lower ends do not contact the furnace body. Also, during the commencement of the furnace's operation the electrodes must be elevated above the charge of metallic material. The electrodes are then slowly fed into the furnace as a charge melts and the lower ends of the electrodes become worn or broken away. For these reasons, electrodes are normally mounted on a support assembly which is constructed and arranged for controlled vertical movement.

One type of electrode support assembly includes an electrode arm which carries a clamp at one end for engaging the electrode and the other end of which is supported by means of an elongated column member. The column in turn is supported for vertical movement. One advantageous means for vertically moving such columns includes a cable and sheave assembly. The cable may, for example, be wrapped around a drum and extend from there around one or more sheaves mounted on the column and with the opposite end of the cable dead-ended to the support structure. In this type of apparatus there is an inherent danger that in the event of a failure of the supporting structure, the electrode and its support structure will fall rapidly onto the furnace causing considerable damage.

SUMMARY OF THE INVENTION

An object of the invention is to provide a fail-safe mechanism for the electrode positioning structure of electric arc furnaces.

Another object of the invention is to provide a mechanism for arresting the support columns of electric arc furnace electrodes in the event the associated elevating mechanism fails.

A further object of the invention is to provide means for engaging an electrode support column to prevent rapid descent positioning assembly.

These and other objects and advantages of the present invention will become more apparent from the detailed description thereof taken with the accompanying drawings.

DETAILED DESCRIPTION OF THE PREFERRED EMBODIMENT

Figure 1:
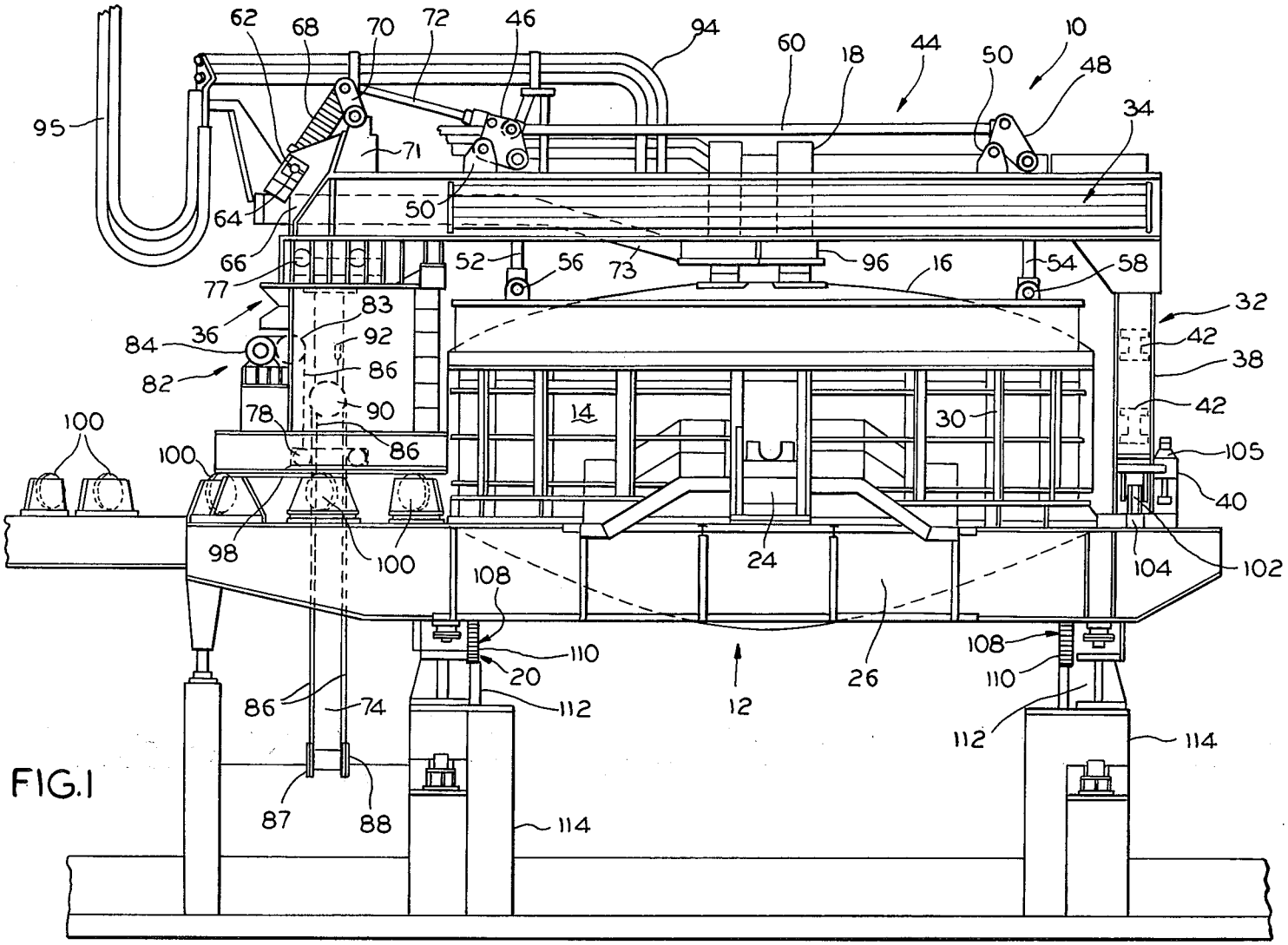
FIG. 1 is a side elevational view of an arc furnace incorporating the present invention.

The electric arc furnace assembly 10 shown in FIG. 1 is of the type with which the preferred embodiment of the invention may be employed and includes a platform 12, a furnace body 14 mounted on platform 12, a furnace cover 16 and a plurality of electrodes 18 which extend through suitable openings in cover 16. Platform 12 may be mounted on a rocker assembly 20 so that the furnace body 12 may be tilted about a horizontal axis so that molten metal may be discharged from a spout (not shown) upon the completion of a furnace operation. In addition, the furnace 10 may be tilted in an opposite direction to permit deslagging through slag door 24.

The platform 12 is of conventional construction and includes structural steel members 26 which engage and support the furnace body 14. The arc furnace consisting of the body 14, the roof 16 and the electrodes 18 is of generally conventional construction and accordingly, will not be discussed in detail. It is sufficient for purposes of understanding the invention to state that the body 10 is generally hollow and circular in plan view and includes a refractory lining and a metallic shell which are surrounded by a structural steel framework 30 supported at its lower end by platform 12. The roof 16 is supported by a gantry 32 which includes a pair of horizontally extending beam assemblies 34 which are supported at one end by a superstructure assembly 36 and at their other end by vertical posts 38 each having a truck assembly 40 at its lower end. The posts 38 are also jointed by suitable cross members 42.

While any suitable mechanism may be provided for elevating the roof 16, in the preferred embodiment, the elevating mechanism consists of a pair of identical elevating assemblies 44, one of which is mounted on each beam assembly 34 and accordingly, only one assembly 44 will be discussed for the sake of brevity. More specifically, elevating mechanism 44 is shown in FIG. 1 to include a pair of crank members 46 and 48 which are each pivotally mounted on one of a pair of spaced apart brackets 50 located adjacent the board and inboard ends of beam 34. Crank member 46 is generally rectangular and is pivotally connected at one of its lower corners to bracket 50 and its other lower corner is pivotally connected to the upper end of a vertically extending connecting rod 52. Crank members 48 is generally triangular and pivotally connected at one corner to bracket 50 and at a second corner to the upper end of a second vertically extending rod 54. The lower ends of rods 52 and 54 are each pivotally connected to the furnace cover 16 at points 56 and 58, respectively. A connecting link 60 is pivotally connected at its opposite ends to one corner of crank 46 and to the apex of crank 48. A hydraulic cylinder 62 is pivotally mounted by trunnions 64 on a bracket 66 affixed to the inboard end of beam assembly 34. A rod 68 extends from and is connected to the piston of cylinder 62 and its opposite end is pivotally connected to an arm 70, the lower end of which is also pivotally mounted on a bracket 71 secured to beam 34. A link member 72 also pivotally connects the upper end of arm 70 to crank member 46.

Figure 2:
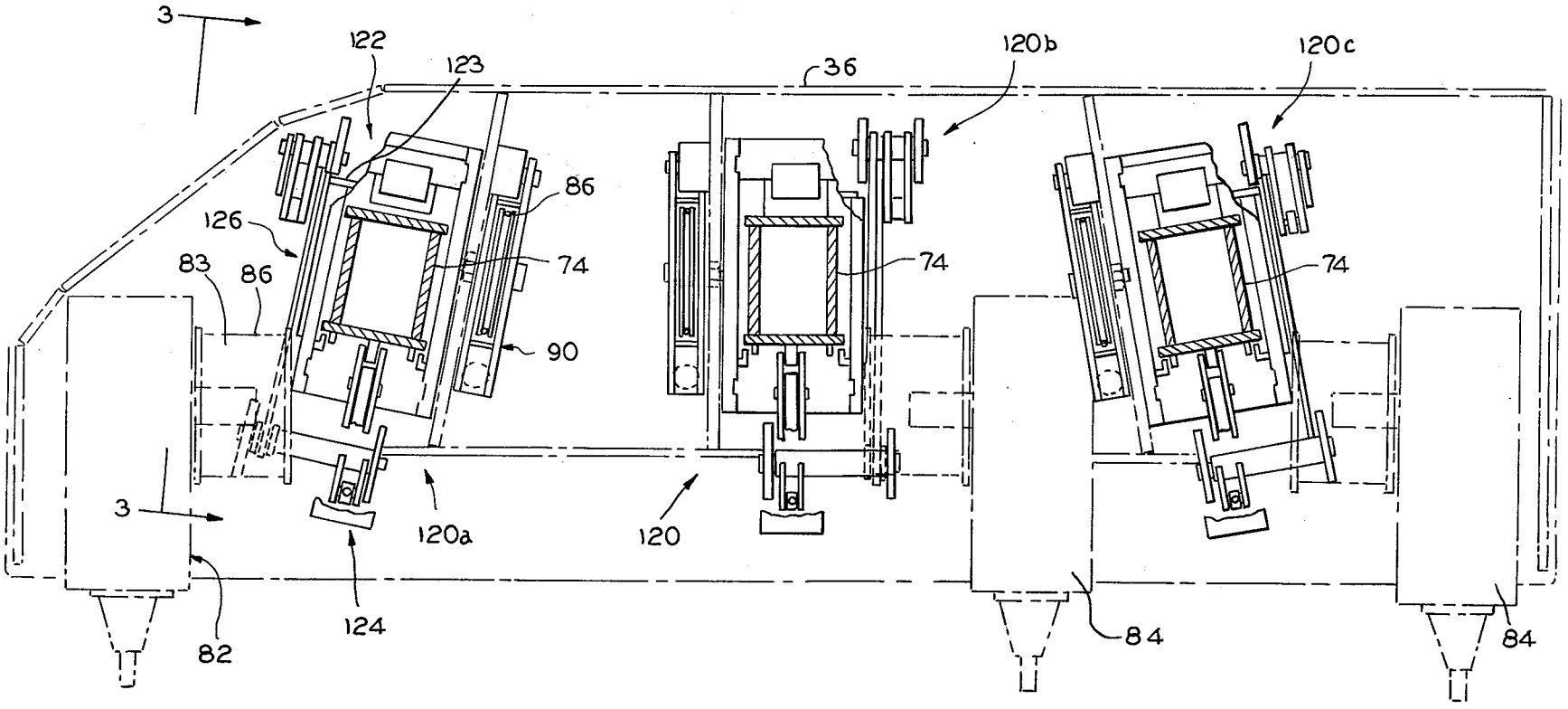
FIg. 2 is a top plan view of the fail-safe mechanism usable with the furnace illustrated in FIG. 1.

Cylinder 62 is double-acting so that when it is pressurized in a first direction such that rod 68 moves inwardly, each of the cranks 46 and 48 will be rocked counterclockwise as viewed in FIG. 2 so that the cover 16 will be elevated to the agency of rods 52 and 54. On the other hand, when the cover 16 is in an elevated position and cylinder 62 is pressurized in the opposite direction, each of the cranks 46 and 48 will be rocked clockwise to return the cover to its closed position shown in FIG. 1. It will be appreciated that a suitable hydraulic supply system will be provided for being connected to cylinder 62 for providing a pressurized fluid thereto and that suitable means will be provided to retain cover 16 in its elevated position as may be required.

The electrodes 18 are each supported at one end of a support arm 73 while the opposite end of each arm 73 is coupled to the upper of a vertical column 74. In the illustrated embodiment the furnace 10 is of the three phase type and accordingly three electrodes 18 are provided although only 2 can be seen in FIG. 1. Accordingly, three electrode arm 73 will be provided with an individual positioning column 74 coupled to each.

Each of the columns 74 is supported for vertical movement on the superstructure 36 by means of a pair of vertically spaced apart roller assemblies 78 which include rollers engageable with the opposite sides of column 74, a cable assembly 82 is provided for moving the column 74 vertically with respect to the roller assemblies 77 and 78.

In the illustrated embodiment, the cable assembly 82 includes a drum 83 coupled to a drive motor 84 and around which is wrapped one end of a cable 86. In addition, a pair of sheaves 87 and 88 are mounted at the lower end of column 74 and a third sheave 90 is rotatably mounted on the superstructure 76 intermediate the ends of the column 74. The cable 86 extends downwardly from drum 83 and around sheave 86, back upwardly and over sheave 90, downwardly therefrom around sheave 86 and back upwardly where it is deadended at a dead end 92. From the foregoing it will become apparent that when the drum 83 is rotated to reel in cable 86, the column 74 and its associated electrode support 73 are elevated while rotation of drum 83 in the opposite direction to reel out cable 86 will lower the column 74 and electrode support arm 73.

Suitable bus bars 94 and electrical connectors 95 connect an electrode clamp 96 mounted at the end of each arm 73 to a suitable three phased transformer (not shown) for energizing each of the electrodes whereby an an arc may be struck between their lower ends whereby the desired heat is provided to the metallic charge within the furnace 10. The lower end of the superstructure 36 includes a bearing plate 98 which rests atop a plurality of roller assemblies 100 mounted on a platform 112 in a circular array having its center of curviture at the center of the superstructure 36.

It will be recalled that the opposite end of gantry 32 is supported on trucks 40. Each of the trucks 40 includes wheels 102 which are mounted on tracks 104 a first portion of which is mounted on the platform 12 and a second portion of which is mounted on the adjacent work floor (non shown). These tracks 104 are arcuate and have a center of curviture at approximately the axis of a superstructure 36. Each of the trucks 40 may also include a drive motor 105 for moving the assembly gantry 32 across the tracks 104 so that the cover assembly 60 and the electrodes 18 may be moved from a position above the furnace body 12 to a remote position whereby the furnace may be charged. After the furnace body has been charged, the cover 16 is normally repositioned above the furnace body 12 and lowered into its operative position after which the electrodes 18 may be moved toward the furnace charge for processing of the furnace charge.

It will be appreciated that each of the columns 74 is supported by individual cable assembly 82. Should their associated cable lose tension the column 74 and the electrode support arm 73 tend to move rapidly downwardly toward the furnace body 10. In order to prevent the electrode support assembly from falling in this manner, the fail-safe assembly 120 shown in FIGS. 2–8 is provided. As seen, particularly in FIG. 2, the fail-safe assembly 120 includes a fail-safe unit associated with each electrode support column 74. Since the invention is illustrated with respect to a three phase furnace, three-fail-safe units **120*a*, 120*b* and 120*c* are shown. Except for the orientation of various components, the fail-safe units 120*a*, 120*b* and 120*c* are identical, and accordingly, only unit 120*a*** will be discussed in detail for the sake of brevity.

The rocker assembly 20 includes a pair of main rocker segments 108 disposed in parallel spaced apart relation. Each rocker segment 108 has an arcuate lower toothed portion 110 which engages a linear toothed member 112 supported on a pair 114. The center of curvature of toothed portions 110 defines the pivot axis of furnace body 14. As those skilled in the art will appreciate, the platform 12 and furnace body 14 may tilt on rocker assembly 20 by hydraulic tilt cylinders (not shown).

In general terms, the fail-safe unit **120*a* includes a clamp assembly 122 disposed adjacent its associated column 74, a spring assembly 124 coupled to the clamp assembly 122 and a linkage assembly 126 which connects the spring assembly 124 to the column support cable 86. The spring assembly 124 tends to bias the clamp assembly 122 into high pressure engagement with the column 74 but is normally restrained by the linkage 126 assembly mounted atop a support base 123 and when there is a predetermined tension in the cable 86**.

Figure 8:
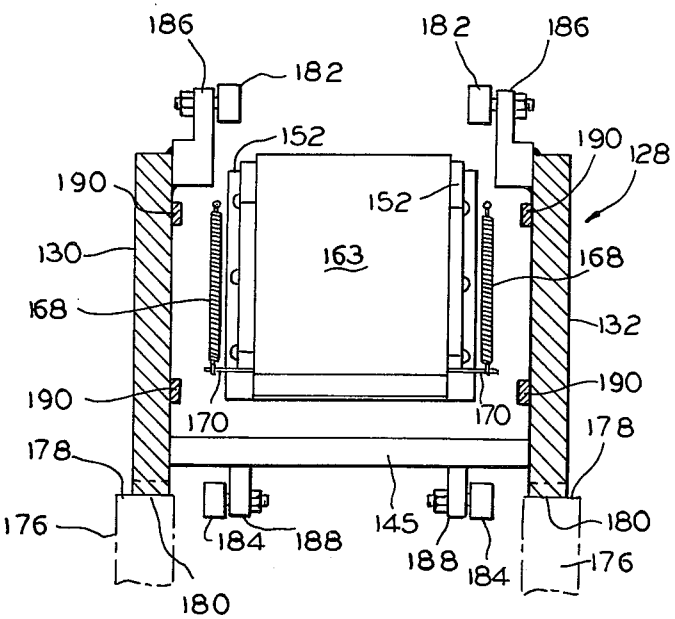
FIG. 8 is a view taken along lines 8—8 of FIG. 6.
Figure 7:
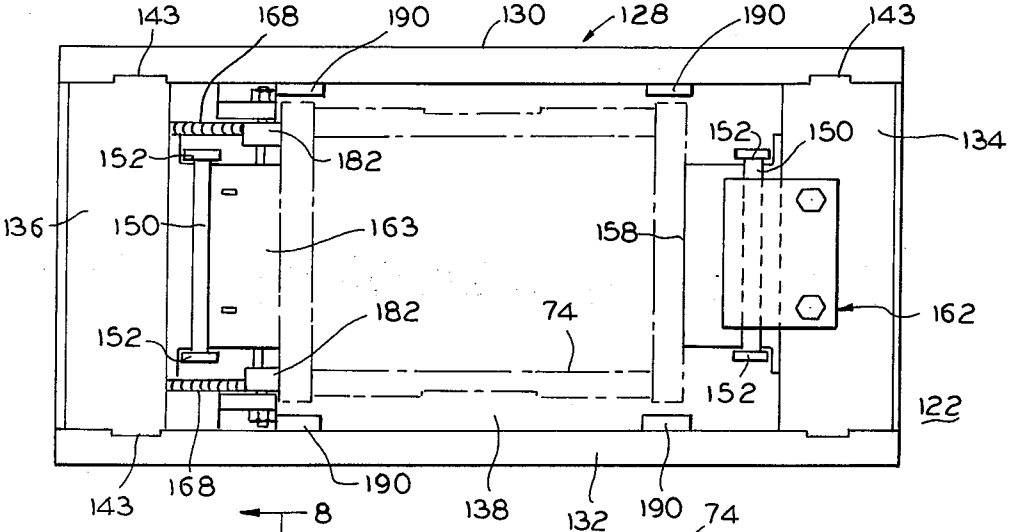
FIG. 7 is a view taken along lines 7—7 of FIG. 6.
Figure 6:
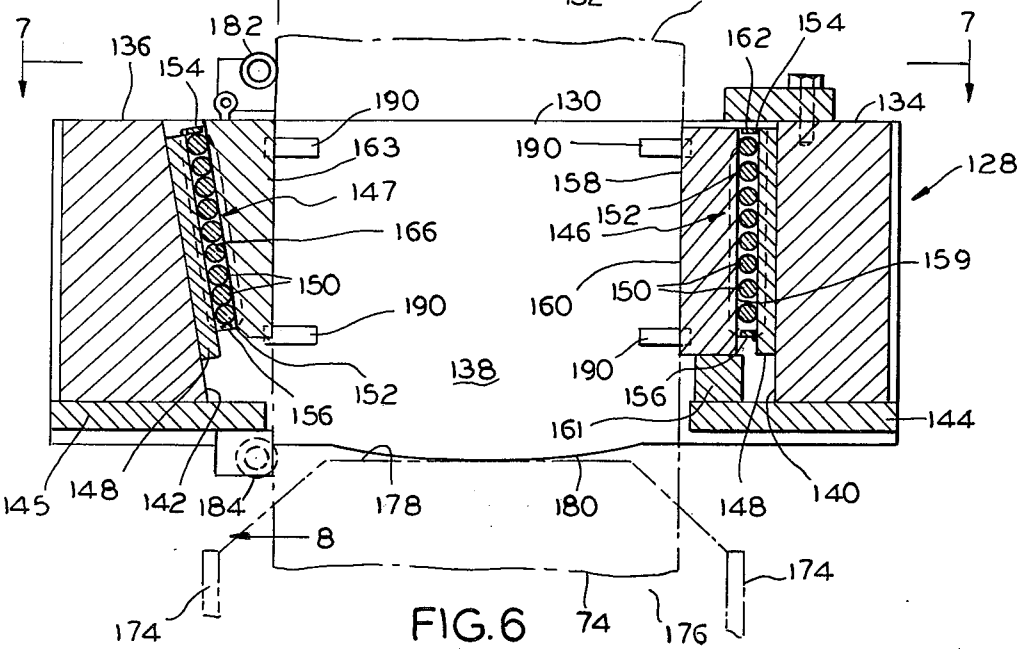
FIG. 6 is a view taken along lines 6—6 of FIG. 4.

The clamp assembly 122 is shown in FIGS. 6, 7 and 8 to include a yoke 128 which is generally rectangular in plan view and to comprise a pair of side plates 130 and 132 and a pair of end blocks 134 and 136. Side plates 130 and 132 are spaced apart and disposed in a generally parallel and vertical relation with the end blocks 134 and 136 disposed between the ends thereof to define a vertical space 138 through which the column 74 extends. End block 134 is generally rectangular in vertical section and has a vertical surface 140 facing the opening 138. The block 136 is generally trapezoidal in vertical section to define an internal surface 142 which is inclined outwardly from its lower to its upper end. The overlapping surfaces of plates 130 and 132 with blocks 134 and 136 are notched at 143 to help sustain the expected high pressure loading. In addition, a pair of bottom plates 144 and 145 are suitably affixed to and extend between side plates 130 and 132 and below end blocks 134 and 136 to help support the latter. Those skilled in the art will appreciate that the various members which comprise the yoke may be joined in any suitable manner such as by welding.

Roller assemblies 146 and 147 are respectively mounted on the surfaces 140 and 142 of end blocks 134 and 136, respectively, and each includes a mounting plate 148 affixed to its associated end block surface and a plurality of elongate rollers 150 mounted for rotation about horizontal axes in a pair of elongate, generally parallel bearing members 152. The rollers 150 are all of equal length and maintain the bearing members 152 in a generally parallel relation. The ends of the bearing members 152 are interconnected by means of cross members 154 and 166 affixed to their opposite ends. As seen in FIG. 6, the individual axes of rollers 150 which comprise roller assembly 146 lie in a substantially vertical plane while those of assembly 147 lie in an inclined plane substantially parallel to surface 142.

A generally rectangular slide block 158 is disposed with one side surface 159 oriented generally vertically and in engagement with rollers 150 and the other side surface 160 oriented generally vertically and facing column 74. Block 158 is unaffixed to the yoke assembly 128 and rests on a support block 161 suitably affixed to the bottom plate 144. Vertically upward movement of block 158 is limited by a restraining plate 162 bolted to the upper surface of block 134 and extending inwardly to overlie a portion of block 158.

Disposed at the opposite side of the yoke assembly 128 and in an opposed relation to the slide block 158 is a wedge block 163. As seen in FIG. 6, block 163 is wider at its upper end and includes a first planar surface 164 which is substantially parallel to surface 142 and engages the rollers 150 of assembly 147. The opposite surface 166 of block 163 is generally vertically oriented and faces the column 74. Wedge block 163 is generally unsupported at its lower end except for a pair of springs 168 which are affixed at their lower ends to pins 170 which extend laterally from the lower end of block 163 and which are affixed at their upper ends to the surface 142 of end block 136.

The support base 123 is affixed to the superstructure 36 and includes vertically oriented end plates 174 and side plates 176 which are joined at their lateral edges to form a box-like assembly which is generally rectangular in horizontal section. The upper ends of side plates 176 extend above the edges of end plates 174 and each terminates in a horizontally extending, generally planer, upper edge surface 178. With reference to FIG. 8, it can be seen that the plates 176 of support base 123 are spaced apart a distance equal to that between the plates 130 and 132 of yoke 128. Also, as seen more particularly in FIG. 6, the lower edges 180 of plates 130 and 132 are generally arcuate and one rests atop each upper edge surface 178 of plates 176.

Since the clamp assembly 122 is not affixed to the support base 123, it is free to assume the attitude of the column 74. Specifically, column 74 is generally rectangular in horizontal section as seen in FIG. 7 and the distance along the major axis of its horizontal section is slightly less than the distances between the surfaces 160 and 166 of blocks 158 and 163, respectively, when block 163 is in its normal position under the influence of springs 168. In order to maintain this slight separation between wedge block 163 and column 74, pairs of upper and lower cam rolls 182 and 184 are provided. The upper cam rolls 182 are supported for rotation about alligned, generally horizontal axes on cam roll mountings affixed to the inner surfaces of side plates 130 and 132 adjacent to and on the opposite sides of wedge block 163. Similarly, the lower cam rolls 184 are mounted for rotation about coaxial horizontal axes by means of cam roll mountings 188 affixed to the lower surface of bottom plate 145 at a point generally below wedge block 163.

Cam rolls 182 and 184 are generally equal in size and their axes are coplaner so that corresponding points on their peripheries define a substantially vertical plan which is spaced a short distance from the surface 166 of wedge block 163. Accordingly, the clamp assembly 122 assumes a position relative to column 74 such that surface 160 of slide block 158 engages one side of the column and cam rolls 182 and 184 engage the opposite side. As seen in FIG. 7, the width of column 74 is less than that between side plates 130 and 132 of yoke 128. In order to prevent the engagement between plates 130 and 132 and column 74, bumper blocks 190 may be affixed to the inner surface of plates 130 and 132 and adjacent the corners of column 74.

Figures 3, 4, 5:
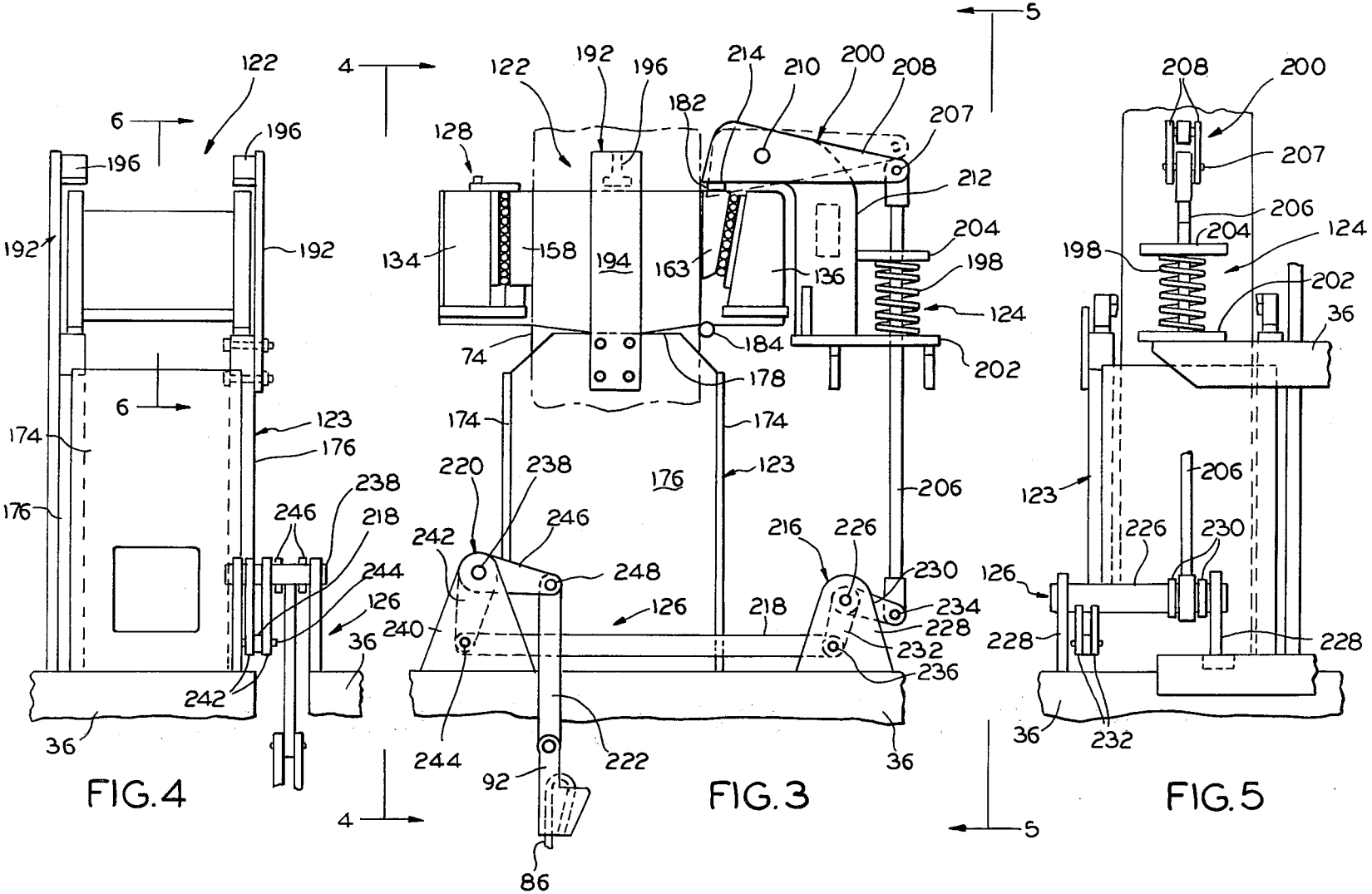
FIG. 3 is a view taken along lines 3—3 of FIG. 2.
FIG. 4 is a view taken along 4—4 of FIG. 3.
FIG. 5 is a view taken along lines 5—5 of FIG. 3.

Referring now to FIGS. 3, 4 and 5, a yoke stop bracket 192 is affixed to each of the side plates 176 of support base 123 and adjacent the opposite sides of yoke 128. Each stop bracket 192 includes an elongate member 194 suitably affixed at its lower end to side plate 176 and extending upwardly therefrom in general parallelism with one of the walls 130 or 132 of yoke 128. At the upper end of each member 194 and extending inwardly over the adjacent yoke side plate, is a stop 196. It can be seen therefore, that yoke stop bracket 192 limits movement of the yoke 122 away from support base 123.

In spring assembly 124 is shown in FIGS. 3 to 5 to comprise a spring 198 which tends to urge an operating arm 200 assembly into engagement with the upper edge of wedge block 163 to force the same into high pressure engagement with the column 74. This action is, however, normally prevented by the linkage assembly 126 as will be discussed more fully below. The spring assembly 124 is supported on the superstructure assembly 36 by means of a horizontally extending support 202. The axis of spring 198 extends generally vertically with its lower end engaging plate 202 and its upper end engages a ram plate 204 which is affixed to a vertically extending link 206. The lower end of link 206 is connected to the linkage assembly 126 as will be discussed below. The upper end of link 206 is pivotally connected by means of a pin 207 to one end of each of a pair of closely spaced parallel operating arms 208 of the operating arm assembly 200. The operating arms 208 extend generally horizontally from the upper end of link 206 and are pivoted intermediate their ends on a pin 210 affixed to a curvate fulcrum member 212 affixed at its lower end to plate 202 and extending upwardly therefrom and then inwardly above end block 136 of yoke 128. The remote ends of operating arms 208 are disposed above wedge block 163 and a bar 214 is affixed thereto at their lower edges and at point corresponding generally to the mid-region of the block's upper surface.

The linkage assembly 126 includes a first crank 216 which interconnects link 206 with a horizontally extending link 218 and a second crank 220 which interconnects horizontal link 218 to a vertical link 222, the lower end of which is connected to a deadend 224 of cable 86. As seen more particularly in FIGS. 3 and 5, the first crank 216 includes a first shaft 226 journalled for rotation about a substantially horizontal axis in a pair of vertical bracket members 228 which are affixed at their lower ends to the superstructure 36. Extending from and affixed to shaft 226 are first and second pairs of crank arms 230 and 232. Crank arms 230 are located generally below spring assembly 124 and are pivotally connected at their outer end to the lower end of link 206 by means of a pin 234. The crank arms 232 are disposed at the opposite end of shaft 226 and are pivotally connected at their outer ends to one end of link 218 by pin 236. The length of shaft 226 and the location of crank arms 232 are such that the link 218 extends along the side of the support base 123 and in general parallelism with the side plate 176 from point generally below the spring assembly 124 to the opposite side of the apparatus.

Crank assembly 220 is shown in FIGS. 3 and 4 to include a generally horizontally extending shaft 238 which is journalled for rotation between vertically oriented brackets 240 which are affixed at their lower ends to the superstructure 36. Shaft 238 extends in general parallelism with shaft 226 and includes a first pair of crank arms 242 which radiate therefrom and are pivotally connected by a pin 244 to the other end of link 218. A second pair of crank arms 246 also radiate from shaft 238 and are pivotally connected to the upper end of link 222 by a pin 248. Link 222 extends downwardly from crank arms 246 and is pivotally connected at the lower end to a deadend 224 to which the end of cable 86 is anchored.

It will be appreciated from the foregoing discussion that the weight of the electrode 18, its support arm 73 and the column 74 will be reflected in a downward force on cable 86 as viewed in FIG. 3. This force will tend to rock crank 220 clockwise and thereby translate link 218 toward the left. This action will in turn tend to pivot crank 216 clockwise thereby exerting a downward force on link 206. If the force exerted by cable 86 is sufficient, spring 198 will be compressed thereby holding operating arms 208 in their position shown by full lines in FIG. 3. The springs 168 (FIGS. 7 and 8) will thereby hold wedge block 163 in a retracted position and behind the plane defined by the cam rollers 182 and 184. Under these circumstances, the column 74 is free to slide vertically as the electrode 18 coupled thereto is positioned during normal furnace operation.

In the event there is a loss of tension in cable 86, such that there is insufficient force to hold spring 198 in a compressed state, the latter will be free to rock operating arms 208 counterclockwise as viewed in FIG. 3 and from their position shown by full lined to that shown by broken lines. This forces the wedge block 163 downwardly and across the plane defined by cam rollers 182 and 184 and into high pressure engagement with the column 74. As a result of this wedging action, the column 74 is prevented from moving vertically downward, In this manner the electrode and its supporting structure are prevented from falling onto the remaining furnace structure in the event of cabel failure.

The loss of cable tension may be the result of some factor other than cable failure, For example, if the electrode in its downward traverse should engage a piece of non-conductive scrap, the cable 86 will become momentairly slack and then tension will be reestablished. Under these circumstances, the rollers 150 behind slide block 158 provide an anti-friction bearing which permits the column 74 to move upward thereby disengaging from the clamp assembly 122 when tension is reestablished.

While only a single embodiment of the invention has been illustrated and described, it is not inteded to be limited thereby but only by the scope of the appended claims.

I claim:

1. An electric arc furnace including a furnace body and at least one electrode, electrode support means constructed and arranged for moving said electrode vertically relative to said furnace body, said electrode support means including cable means engageable with said electrode support means for moving the same vertically, clamping means disposed adjacent said electrode support means and operable to clamp on said electrode support means to prevent vertical movement thereof, biasing means urging said clamping means into clamping engagement with said electrode support means, restraining means coupled to said clamping means and to said cable means and operative in response to a predetermined tension in said cable means for restraining said clamping means to prevent engagement with said electrode support means, said restraining means incapable of restraining said clamping means when the tension in said cable means decreases from said predetermined tension.

2. The apparatus set forth in claim 1 wherein said electrode support means includes column means and means for supporting an electrode from said column means, said column means being disposed generally vertically and being supported for generally vertical movement by said cable means.

3. The apparatus set forth in claim 2 wherein said clamping means includes a clamping element disposed adjacent said column means, said biasing means being coupled to said clamping element for urging the same into engagement with said column means.

4. The apparatus set forth in claim 3 wherein said biasing means includes spring means, and first means coupling said spring means to said clamping element, said spring means normally urging said clamping element into engagement with said column means.

5. The apparatus set forth in claim 4 wherein said restraining means includes linkage means coupled to said cable means and to said spring means, said linkage means transmitting a compressive force from said cable means to said spring means.

6. The apparatus set forth in claim 5 wherein said clamping element includes wedge block means, yoke means mounted adjacent said column means and supporting said wedge block means for low frictional movement toward and away from said column means.

7. The apparatus set forth in claim 6 wherein said yoke means surrounds said column means and includes a first block disposed on one side thereof for engaging said column means, said wedge block means being disposed on the opposite side of said column means and being arranged for engagement therewith, cam means disposed on said yoke means and adjacent said wedge block means for engaging said column means to position said yoke means relative to the one side of said column means and resilient means for resiliently supporting said wedge block means in spaced relation from said column means when said wedge block means is restrained, said spring means being operative when said restraining means is ineffective for moving said first means into engagement with said wedge block means to force the same into high pressure engagement with said column means and against said resilient means.

8. The apparatus set forth in claim 7 and including first roller means disposed between said yoke means and said first block means, said first roller means supporting said first block means for limited movement in a direction generally parallel to the direction that said column means is moved, said second roller means supporting said wedge block means for movement on said yoke means at an inclined acute angle relative to the direction that said column means is moved.

9. The apparatus set forth in claim 8 wherein said first means includes arm means pivotally mounted intermediate its ends for movement relative to said yoke means, said arm means engaging said wedge block means on one side of its pivotal axis and being engaged by said spring means on the opposite side of said axis.

10. The apparatus set forth in claim 9 wherein said linkage means includes crank means, said crank means engaging said spring means and said cable means, said cable means holding said crank means in a rotated position to compress said spring means, the release of said cable means allowing said crank means to pivot and thereby said spring means to pivot said arm means into engagement with said wedge block means.

11. The apparatus set forth in claim 1 wherein said clamping means includes wedge block means, yoke means mounted adjacent said electrode support means and supporting said wedge block means for low frictional movement toward and away from said electrode support means.

12. The apparatus set forth in claim 11 wherein said yoke means surrounds said column and includes a first block disposed on one side thereof for engaging said column means, said wedge block means being disposed on the opposite side of said column and being arranged for engagement therewith, cam means disposed on said yoke means and adjacent said wedge block means engaging said column means to for position said yoke means relative to the one side of said column means and resilient means for resiliently supporting said wedge block means in spaced relation from said column means and against said resilient means.

13. The apparatus set forth in claim 12 and including first roller means disposed between said yoke means and said first block means, said first roller means supporting said first block means for limited movement in a direction generally parallel to the direction that of said column means is moved.

14. The apparatus set forth in claim 13 when said clamping means includes arm means pivotally mounted intermediate its ends for movement relative to said yoke means, said arm means engaging said wedge block means on one side of its pivotal axis and being engaged by said spring means on the opposite side of said axis.

15. The apparatus set forth in claim 14 wherein said biasing means includes spring means crank means, said crank means engaging said spring means and said cable means, said cable means holding said crank means in a rotated position to compress said spring means, the release of said cable means allowing said crank means to pivot and thereby said spring means to pivot said arm means into engagement with said wedge block means.

16. An electric arc furnace including a furnace body and at least one electrode, electrode support means including a vertically movable column, electrode positioning means operative to move said electrode support means generally vertically relative to said furnace body and including cable means engagable with said column means for supporting the same, clamping means disposed adjacent said column means and operable to clamp onto said column means to prevent verticle movement thereof, spring means urging said clamping means into clamping engagement with said column means, linkage means coupled to said clamping means and to said cable means and operative in response to a predetermined tension in said cable means for compressing said spring means to prevent said spring means from urging said clamping means into engagement with said column means, said spring means being operable to expand for moving said clamping means into engagement with said column means.

17. The apparatus set forth in claim 16 wherein said clamping means includes yoke means surrounding said column means and a first block disposed on one side said yoke means for engaging said column, surface means formed on the other side of said yoke means and lying in a plane intersecting the direction of column movement at an acute angle, wedge block means disposed adjacent said surface means and being supported for low frictional movement thereon toward said column means, said linkage means engaging said wedge block means.

18. The apparatus set forth in claim 17 when said linkage means includes arm means pivotally mounted intermediate its ends for movement relative to said yoke means, said arm means engaging said wedge block means on one side of its pivotal axis and being engaged by said spring means on the opposite side of said axis, said linkage means also include crank means, said crank means engaging said spring means and said cable means, said cable means holding said crank means in a rotated position to compress said spring means, release of said cable means allowing said crank means to pivot and thereby said spring means to pivot said arm means into engagement with said wedge block means.

19. An electric arc furnace including a furnace body and at least one electrode, electrode support means including a vertically movable column, electrode positioning means operative to move said electrode support means generally vertically relative to said furnace body and including cable means engagable with said column means for supporting the same, clamping means disposed adjacent said column means and operable to clamp onto said column means to prevent verticle movement thereof, said clamping means including first and second clamping elements engagable with said column means, biasing means responsive to a loss of tension in said cable means for urging said first clamping element into engagement with said column whereby said column is clamped between said clamping elements to prevent downward movement thereof, and low friction bearing means for supporting at least one of said clamping elements for movement in a direction generally parallel to the direction that said column means moves whereby said column means may be disengaged from said clamping means should tension in said cable means be reestablished.

20. The apparatus set forth in claim 19 wherein said first clamping element comprises wedge block means, yoke means mounted adjacent said column means and supporting said wedge block means for low frictional movement toward and away from said column means.

21. The apparatus set forth in claim 20 wherein said yoke means surrounds said column means said wedge block means being posed on one side thereof for engaging said column means, said second clamping element being disposed on the opposite side of said column means and being arranged for engagement therewith, said low friction bearing means being disposed between said second clamping element and said yoke means.

22. The apparatus set forth in claim 20 and including cam means disposed on said yoke means and adjacent said wedge block means for engaging said column means to position said yoke means relative to the said column means and resilient means for resiliently supporting said wedge block means in spaced relation from said column means when said wedge block means is restrained, said biasing means being operative for forcing said wedge block means into high pressure engagement with said column means and against said resilient means.

23. The apparatus set forth in claim 22 and wherein said low friction bearing means includes first roller means disposed between said yoke means and said second clamping element, said first roller means supporting said second clamping element for limited movement in a direction generally parallel to the direction that said column means is moved, and second roller means supporting said wedge block means for movement on said yoke means at an inclined acute angle relative to the direction that said column means is moved.

* * * * *

UNITED STATES PATENT AND TRADEMARK OFFICE

CERTIFICATE OF CORRECTION

PATENT NO. : 4,140,867

DATED : February 20, 1979

INVENTOR(S) : Peter J. Wynne

It is certified that error appears in the above—identified patent and that said Letters Patent is hereby corrected as shown below:

Column 10, Claim 16, line 7, cancel "onto".

Column 10, Claim 19, line 57, cancel " onto"

Signed and Sealed this

*Seventeenth* Day of *March 1981*

[SEAL]

*Attest:*

RENE D. TEGTMEYER

*Attesting Officer*

*Acting Commissioner of Patents and Trademarks*